United States Patent [19]

Andersson

[11] 4,119,177

[45] Oct. 10, 1978

[54] COLLAPSIBLE LADDER

[76] Inventor: Bengt Heimer Andersson, PL 1722, 310 40 Harplinge, Sweden

[21] Appl. No.: 850,449

[22] Filed: Nov. 10, 1977

[51] Int. Cl.[2] ..... E06C 1/12; E06C 1/38

[52] U.S. Cl. ..... 182/195; 182/228

[58] Field of Search ..... 182/195, 207, 228, 95, 182/215, 220, 166

[56] References Cited

U.S. PATENT DOCUMENTS

| | | | |
|---|---|---|---|
| 1,029,768 | 6/1912 | Schneider | 182/195 |
| 1,495,197 | 5/1924 | Oakley | 182/166 |
| 1,567,447 | 12/1925 | McCracken | 182/195 |
| 2,857,087 | 10/1958 | Pratt | 182/166 |
| 3,653,463 | 4/1972 | Neal | 182/195 |
| 3,997,026 | 12/1976 | Riehlmann | 182/195 |

*Primary Examiner*—Reinaldo P. Machado

[57] ABSTRACT

A collapsible ladder consisting of a plurality of telescoping upright sections in which the uppermost rung of each section is fixedly mounted in the uprights, and in which the uprights of one or more upper sections are provided with longitudinal guideways in which end portions of at least the lowermost one of the rungs of the section are displaceable.

9 Claims, 4 Drawing Figures

COLLAPSIBLE LADDER

This invention relates to collapsible ladders of the type consisting of a plurality of sections, including one bottom section and one or more upper sections, said sections being longitudinally displaceble with respect to each other between a retracted position and an extended position determined by a catch means and comprising each a pair of risers and at least two rungs.

The invention has for its principal object to provide a ladder of the type indicated which in the fully retracted state occupies a particularly small space in all directions while still forming a unit ready for immediate extension into the desired length.

The invention accordingly consists of a ladder of the type above specified in which each of said uprights has a sectional shape allowing it to telescope into the adjoining lower upright and in which the uppermost rung of each of the sections is fixedly mounted in the uprights and in which the uprights of said one or more upper sections are provided with longitudinal guideways in which end portions of at least the lowermost one of the rungs of the section are displaceable along said uprights between a lower terminal position defined by a stop for each of said end portions and an upper terminal position. The rungs of the bottom section are preferably all fixedly mounted in the uprights.

Figure 1:
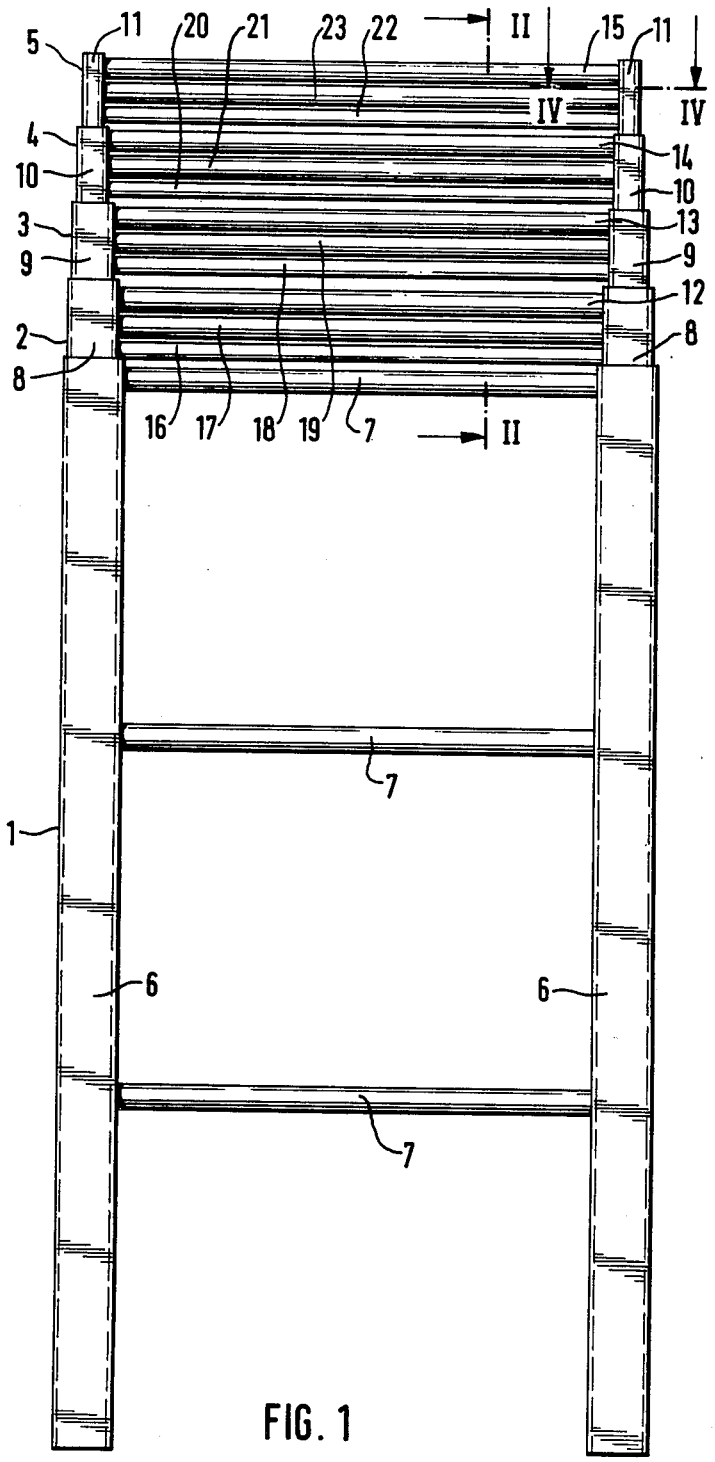
Figure 2:
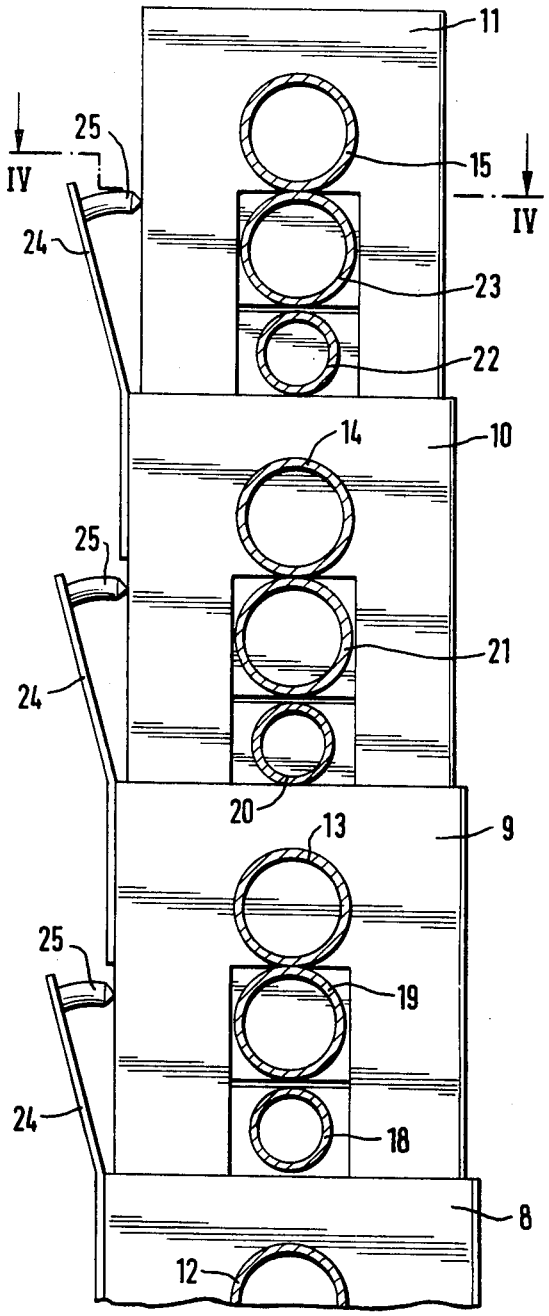
Figure 3:
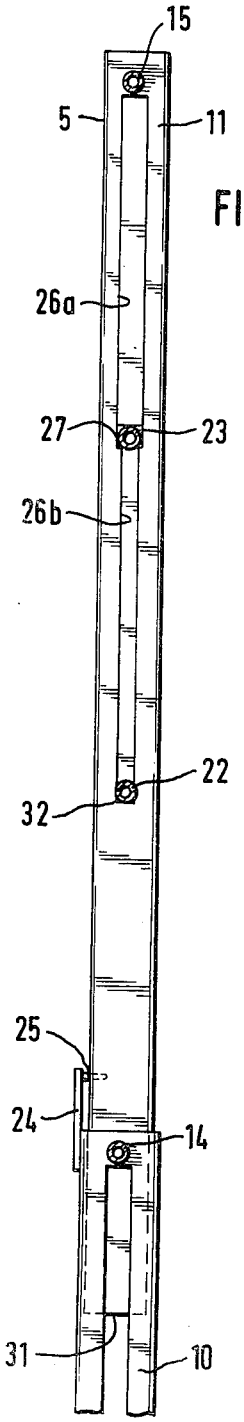
Figure 4:
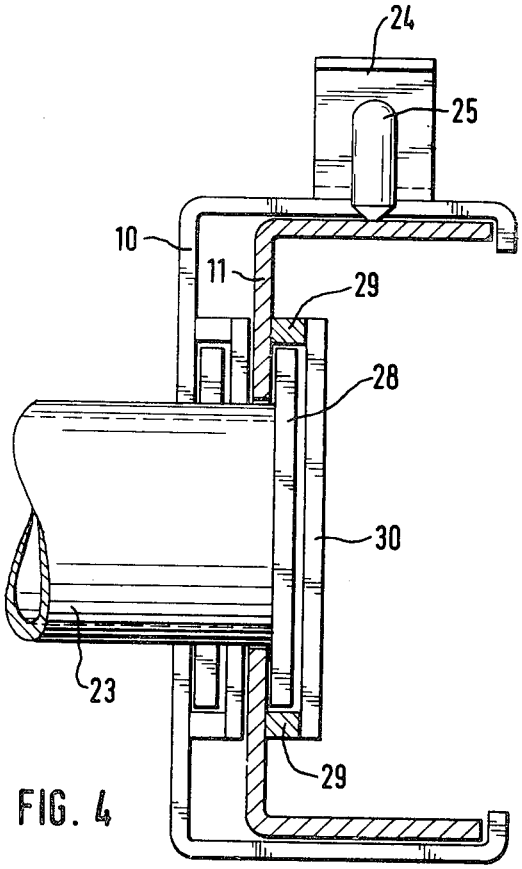

An example of a ladder according to the invention will now be described with reference to the accompanying drawings of which FIG. 1 is a front view of the ladder in a fully retracted position, FIG. 2 is a sectional view on a greater scale than FIG. 1 taken on the line II—II of FIG. 1, FIG. 3 is a sectional view on the same scale as FIG. 1 taken on the same line as FIG. 2 through the top section and part of the next section of the ladder, and, FIG. 4 is a sectional view on a greater scale than FIGS. 1-3 taken on the line IV—IV of FIG. 1.

The ladder consists of five ladder sections 1 to 5, more particularly of one bottom section 1 and four upper sections 2 to 5. The bottom section consists of two uprights 6, 6 and three tubular rungs 7 rigidly attached to said uprights. Each of the upper sections consists of a pair of uprights 8,8, 9,9, 10,10 and 11,11, a top rung 12, 13, 14, 15, respectively, rigidly mounted between the top ends of said uprights and a pair of movable rungs 16-17, 18-19, 20-21 and 22-23, respectively. The sectional size of the uprights increases gradually from the top to the bottom of the ladder by the amount required to make each of the uprights fit into the next one so as to allow telescopical motion of the uprights with respect to each other. This is best seen in FIG. 4 in which the lower uprights 6, 8, 9 have been omitted in order to simplify the picture. One of the uprights 6, 8, 9, 10 of each of the ladder sections 1, 2, 3, 4 is fitted at its upper end with a spring catch consisting of a leaf spring 24 attached to the upright and provided at its free end with a stud 25 arranged to snap under the action of the spring into a bore provided in the adjacent upright so as to maintain the same in the extended position.

The movable rungs 16 to 23 extend through and are displaceable along slots provided in each of the uprights 8 to 11. As all of said slots are identically similar, it is sufficient to described the slot provided in one of the uprights 11. The slot, which is closed at both ends, consists of an upper, wider portion **26*a* and a lower, narrower portion 26*b*, the transition between said slot portions forming a shoulder 27 at each edge of the slot. The lower one 22 of the two movable rungs has a diameter slightly less than the width of the narrow slot portion 26*b*, while the other movable rung 23 has a diameter corresponding to the width of the wider slot portion 26*a* and, consequently, cannot enter the narrow portion of the slot. Each of the movable rungs 22, 23 is provided at both ends with a square flange 28 which engages the wall of the upright 11 on the side facing away from the rung and the other upright 11, while a pair of opposed edges of the flange engage a pair of parallel, straight guide bars 29 attached to the upright 11 and serving in combination with the square flanges 28 to prevent rotation of the rung about its axis. The guide bars 29 are connected by one or more tie members 30 serving mainly to compensate for the loss of strength caused by the slot 26*a*, 26*b***.

The corresponding details of the sections 2, 3 and 4 are identically similar to those of the section 5.

In the extended position represented in FIG. 3, the lower one 22 of the movable rungs 22, 23 rests on the lower edge of the narrow slot portion **26*b*, while the upper rung 23 rests on the shoulders 27 at the lower end of the wider portion 26*a* of the slot. The lower end of the upright 11 is visible at 31 through the slot of the adjacent upright 10**.

To retract the top section 5 into the next section 4, the stud 25 is pulled outwards against the action of the spring 24. If the ladder is kept upright, the weight of the top section 5 thus released will cause the uprights 11,11 of the top section to telescope down into the uprights 10,10 of the next section. The rung 22 when arrested by the upper edges of the uprights 10 will move upwards with respect to the slot **26*b*, 26*a*, carrying before it the rung 23 until the rung 23 hits the upper end of the slot portion 26*a*, thus arresting the downward motion of the top section 5**.

To make a fully extended ladder telescope into the fully retracted state shown in FIG. 1, it is usually preferable first to release the section 2 to cause it to telescope into the section 1, then to release the section 3 to cause it to telescope into the section 2, and so on.

The invention is not limited to the example shown and may be varied in a variety of ways within the scope of the claims. For instance, the end portions of the slots may be guided in slots having the same width throughout their length and cooperate with selective stop members attached to the uprights.

I claim:

1. A ladder consisting of a plurality of sections including one bottom section and at least one additional section, each of said sections comprising a pair of uprights and at least two rungs the uppermost one of which is fixedly mounted in the uprights, each of said uprights being telescopically slidable into the adjoining lower upright, the uprights of said at least one additional section being provided with longitudinal guideways in which end portions of at least the lowermost one of the rungs of the section are displaceable along said uprights, stop means defining a lower terminal position for the end portions of said at least one of the rungs in said guideways, and releasable means for holding each of said sections in an extended position with respect to an adjoining section.

2. A ladder as claimed in claim 1 in which all of the rungs of the bottom section are fixedly mounted in the uprights.

3. A ladder as claimed in claim 1 in which each of the uprights of said at least one additional section is provided at the side facing the other upright with a longitudinal slot for receiving one end portion of said at least one displaceable rung.

4. A ladder as claimed in claim 3 in which said slot is closed below and in which the lower extremity of the slot constitutes the stop defining the lower terminal position of the lowermost rung of the section.

5. A ladder as claimed in claim 3 in which the longitudinally displaceable rungs are provided each at at least one extremity with a flange or projection arranged to engage the slotted wall of the upright beside said slot at the side facing away from the rung.

6. A ladder as claimed in claim 5 in which said flange or projection has at least one straight edge and in which said wall is provided with a straight guide bar slidably engaging said straight edge.

7. A ladder as claimed in claim 1 in which the rung end portions displaceable in said guideways are arranged to prevent rotation of the rung about its horizontal axis.

8. A ladder consisting of a plurality of sections including one bottom section and at least one additional section, each of said sections comprising a pair of uprights and at least three rungs, the uppermost one of which is fixedly mounted in the uprights, each of said uprights being telescopically slidable into the adjoining lower upright, the uprights of said at least one additional section being each provided with a longitudinal guideway for end portions of at least two rungs, to wit, the lowermost and the next but lowermost rung, of the section and with pairs of stops for said end portions, said stops defining a particular lower terminal position for each of said at least two rungs of the section, the stops defining the lower terminal position of a predetermined one of said at least two rungs except the lowermost one being arranged to allow a free passage for the end portions of any rung below said predetermined one.

9. A ladder consisting of a plurality of sections including one bottom section and at least one additional section, each of said sections comprising a pair of uprights and at least three rungs at least one of which is fixedly mounted between the upper ends of the uprights, each of said uprights being telescopically slidable into the adjoining lower upright, the uprights of each of said additional sections being each provided at the side facing the other upright with a longitudinal slot for receiving one end portion of at least two rungs, said slot comprising a number of slot portions having different widths, said number being equal to the number of rungs the end portions of which are received by the slot, the width of any of said portions exceeding the width of the adjoining lower portion of the slot, the rung end portions displaceable along the slot having different widths corresponding to the widths of said slot portion, the transition between a slot portion and the adjacent narrower slot portion constituting a stop for arresting a corresponding rung end portion, and releasable means for holding each of said sections in an extended position with respect to an adjoining section.

* * * * *